US005292097A

United States Patent [19]

Russell

[11] Patent Number: 5,292,097

[45] Date of Patent: Mar. 8, 1994

[54] WORK SURFACE SUPPORT

[76] Inventor: Edwin R. Russell, 414 Stirling Hwy., Cottesloe, Australia

[21] Appl. No.: 907,483

[22] Filed: Jul. 1, 1992

Related U.S. Application Data

[63] Continuation-in-part of Ser. No. 607,448, Oct. 31, 1990, abandoned.

[30] Foreign Application Priority Data

Oct. 31, 1989 [AU] Australia ..... PJ7143

[51] Int. Cl.[5] ..... F16M 11/00

[52] U.S. Cl. ..... 248/281.1; 248/284; 248/918

[58] Field of Search ..... 248/281.1, 284, 291, 248/296, 581, 674, 918, 919; 400/682

[56] References Cited

U.S. PATENT DOCUMENTS 4,616,798 10/1986 Sneenge et al. ..... 2428/918 X
4,691,888 9/1987 Cotterill ..... 248/284
4,706,919 11/1987 Soberalski et al. ..... 248/918 X
5,031,867 7/1991 Cotterill ..... 248/284
5,037,054 8/1991 McConnell ..... 248/284

FOREIGN PATENT DOCUMENTS 0430585 6/1926 Fed. Rep. of Germany ... 248/281.1
0880794 6/1953 Fed. Rep. of Germany ... 248/281.1

*Primary Examiner*—Ramon O. Ramirez
*Attorney, Agent, or Firm*—Harness, Dickey & Pierce

[57] ABSTRACT

A number of embodiments of supports for supporting a support platform for movement relative to a base in a generally parallel orientation through a plurality of positions. The support includes a pair of parallel lengths pivotally connected at their ends to the support platform and the base. A locking mechanism is provided for locking the support platform in any of a plurality of positions and this locking mechanism includes serration formed on one of the support lengths and a cooperating locking member carried by one of the other elements.

52 Claims, 19 Drawing Sheets

WORK SURFACE SUPPORT

This invention relates to a work surface support, and is a continuation-in-part of Ser. No. 07/607,448, now abandoned, filed Oct. 31, 1990.

A particular application of the invention relates to the support for a keyboard for a computer work station.

In one form, the invention resides in a support means for supporting a support platform from a fixed base whereby the support platform is movable between a first position at least partially below the fixed base and a second position in front of the fixed base, said support means comprising a first element adapted to be mounted to the support platform, a second element adapted to be affixed to said fixed base, a pair of linkage elements each pivotally fixed at one end to said first element at spaced intervals on said first element and each pivotally mounted at the other end to said second element at spaced locations on said second element to enable movement of the support platform between the first and second positions whereby throughout such movement the attitude of said support platform remains substantially constant, said support means further comprising a locking means for locking said support platform in a range of positions including said second position, said locking means comprising a first locking member supported on one of said linkage elements and having a first engagement face engagable with a second engagement face provided on a second locking member provided on another of said elements said locking members being relatively moveable between a released position at which the engagable faces are disengaged to allow movement of said support platform relative to said base and a plurality of locking positions at which the engagement faces are engaged to retain said second element relative to said first element in one of said range of positions.

According to a preferred feature the pawl member and locking surface are gravitationally biassed into locking inter-engagement.

The invention will be more fully understood in the light of the following description of several specific embodiments. The description is made with reference to the accompany drawings in which.

Figure 1:
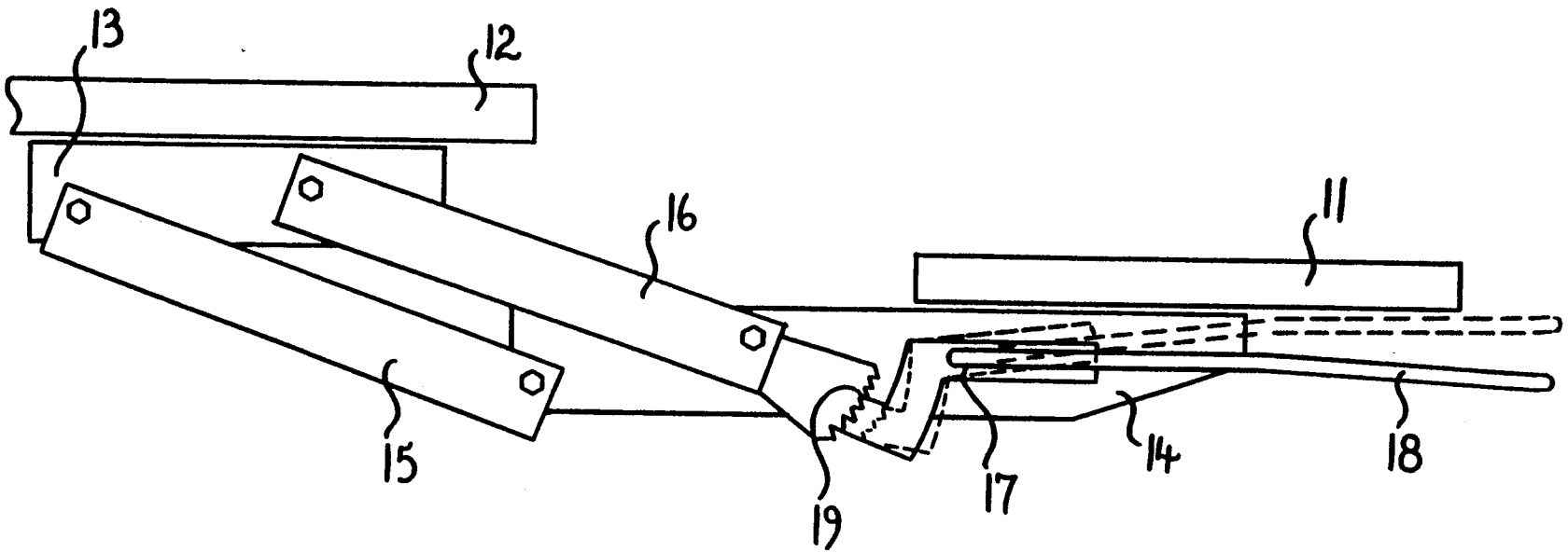
FIG. 1 is a side elevation of the first embodiment in the region of the second position.
Figure 2:
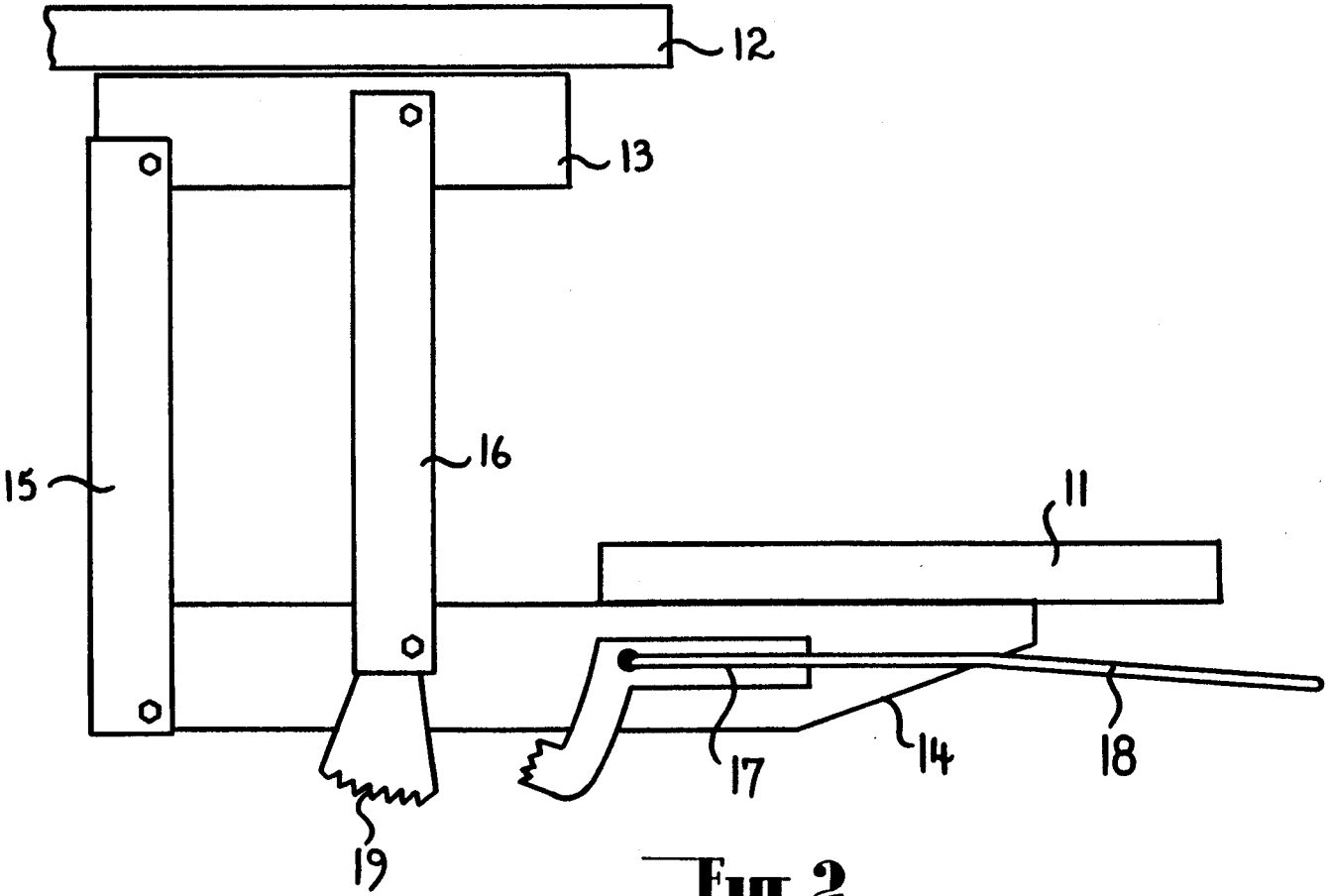
FIG. 2 is a side elevation of the first embodiment in the first position.

The first embodiment shown at FIG. 1 comprises a support for a support platform 11 to facilitate movement of the support platform 11 relative to a fixed member 12 whereby the support platform 11 is movable between a position in front of the fixed member 12 as shown at FIG. 1, and a position below the fixed member 12 as shown at FIG. 2.

The support comprises a first member 13 which is adapted to be fixed underneath the fixed member 12 and a second member 14 which is adapted to be fixed under the support platform and which extends rearwardly from the rear edge of the support platform 11. The first and second members 13 and 14 are interconnected by a pair of substantially parallel link elements 15 and 16 which are pivotally connected at their ends to the first member 13 and second member 14 respectively at spaced positions of the respective members. The result of the presence of the parallelogram linkage provided by link elements 15 and 16 and their pivotal interconnection with the first and second members at 13 and 14 is such that support platform 11 is capable of movement from a position in front of the fixed member 12 to a position below the fixed member 12 as shown as FIGS. 1 and 2 whereby throughout such movement the attitude of the support platform 11 remains substantially constant.

The second member 14 pivotally supports a pawl member 17 which has a general configuration of a bell-crank where one arm extends forwardly and is provided with a forwardly directed handle 18 which is accessible from the front of the support platform 11. The other arm of the pawl member 17 is provided with a set of serrations or teeth which are engagable with a serrated curved locking surface, which is provided at one end of one of the link elements 16 where the mounting of the one link element 16 to the first member is the centre of curvature of the curved locking surface.

On inter-engagement of the respective serrated formations of the pawl member 17 and locking surface 19 the support platform 11 is retained in position. The pawl 17 is engagable with the locking surface 19 for a range of positions including the second position at which the support platform 11 is located forward of the fixed member 12. As a result the support platform can be adjusted to a height satisfactory to the user. In addition the effect of the counterweighting action provided by the handle 18 causes the pawl member 17 to be biased under the influence of the gravity into engagement with the locking surface 19.

Figure 3:
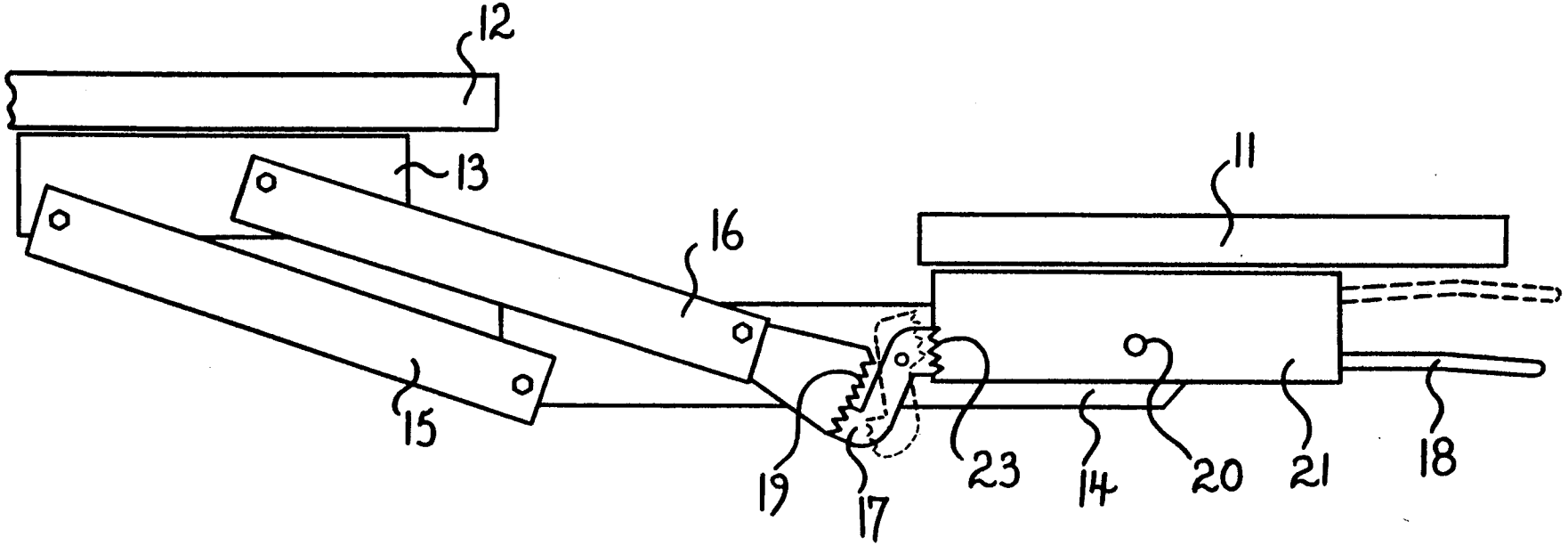
FIG. 3 is a side elevation of the second embodiment in the region of the second position.
Figure 4:
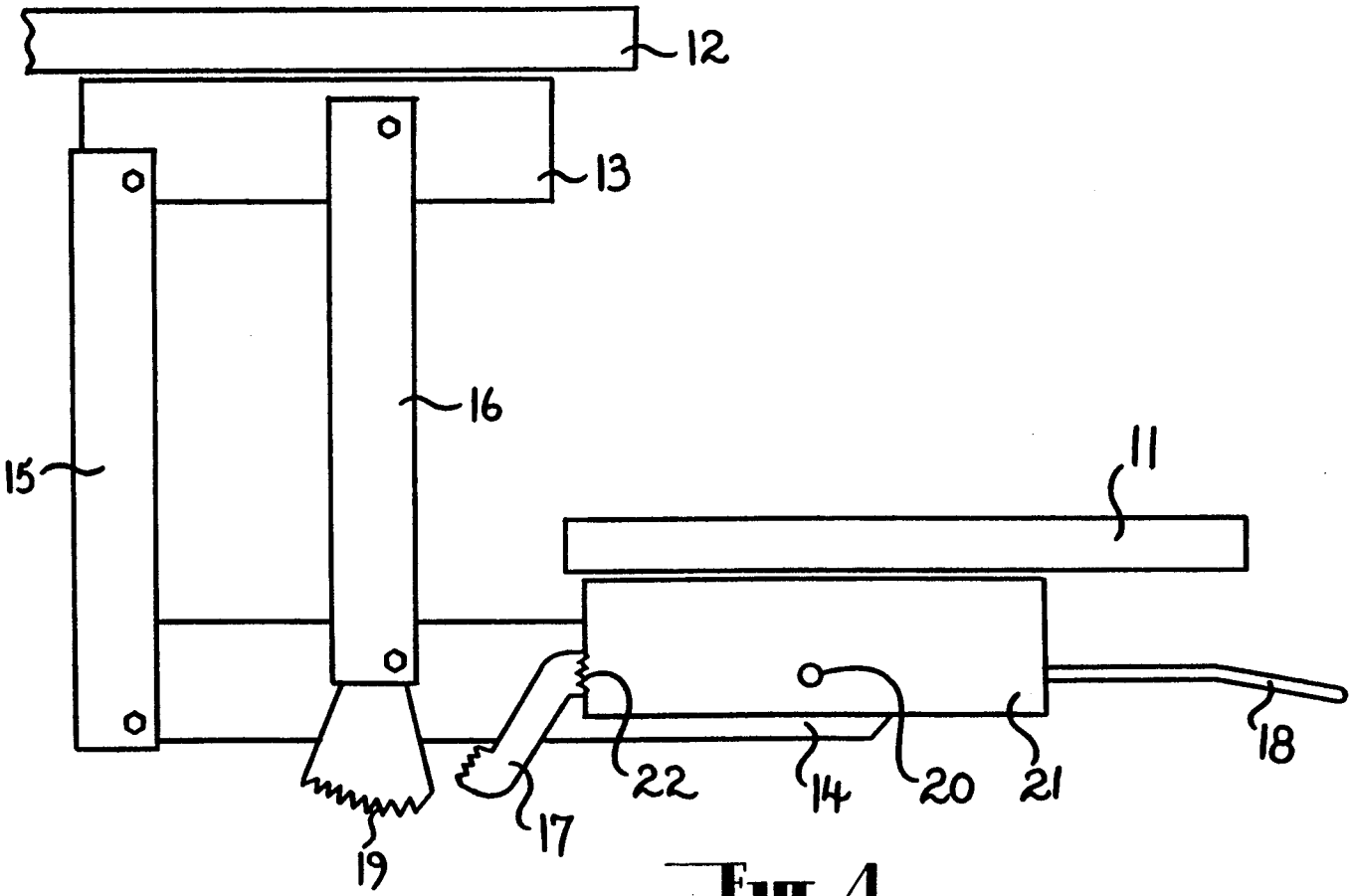
FIG. 4 is a side elevation of the second embodiment in the first position.

In the second embodiment shown at FIGS. 3 and 4 the support platform 11 is supported from a fixed member 12 in a similar manner to that of the first embodiment, the only difference between the embodiments relates to the locking means. In the case of the second embodiment, the locking means further controls the attitude of the support platform 11. In the case of the second embodiment, the support platform 11 is supported from the second member 14 through a transverse pivot axis 20 such that it is pivotable on the second member 14 about said transverse axis. The pivotal movement of the support platform 11 is controlled through the pawl member 17 which is formed as a bell-crank member of similar form to that of the first embodiment and which is engagable with a first locking surface 19 provided at the end of the first link element 16. The engagement between the pawl member 17 and the first locking surface is similar to that of the first embodiment and the pawl member 17 is operated through a handle 18 in a similar manner to that of first embodiment.

The difference between the first and second embodiments however, resides in the presence of a serrated formation at the other end of the other arm of the pawl member 17 which is engagable with a second locking surface 22 which has a serrated configuration and is provided on the support 21 of the support platform 11. On disengagement of the pawl member 17 from engagement with the first locking surface 19 provided on the first link element 16 and also with the second locking surface 22 provided on the support 21 the support platform is not only capable of being raised or lowered with respect to the fixed member 12 but is also capable of pivotal movement about said transverse axis 19.

Figure 5:
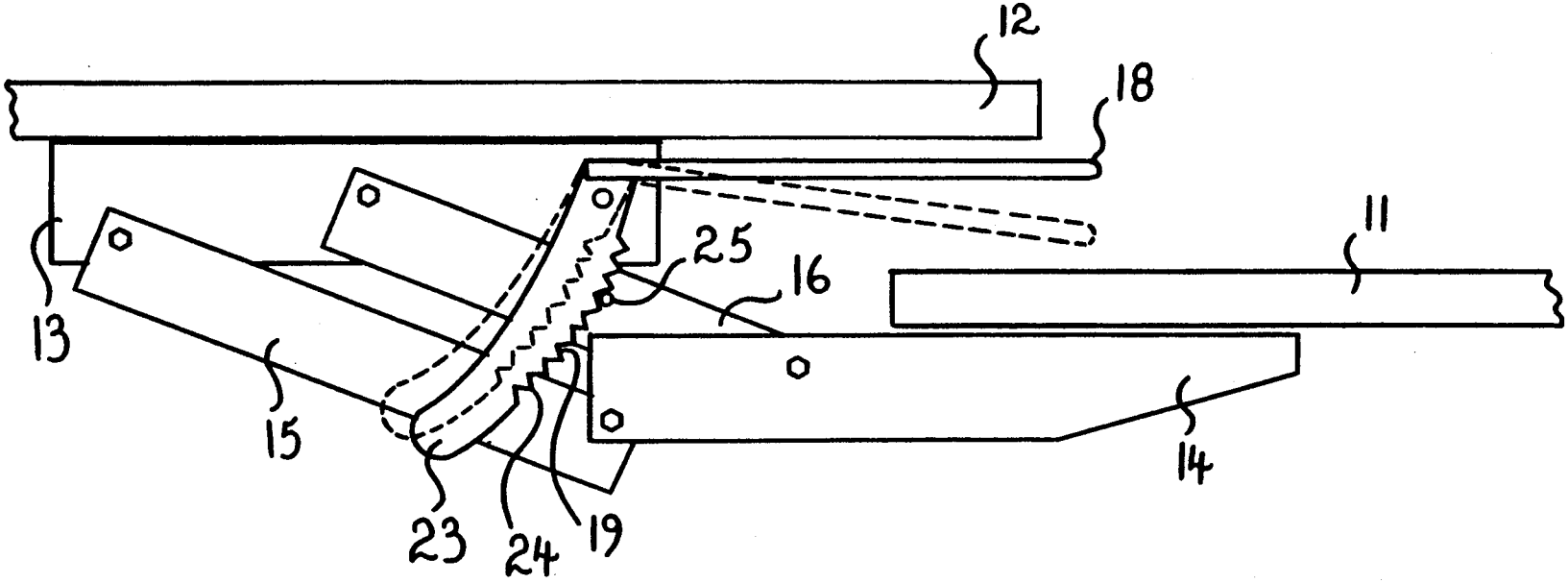
FIG. 5 is a side elevation of the third embodiment in the region of the second position.
Figure 6:
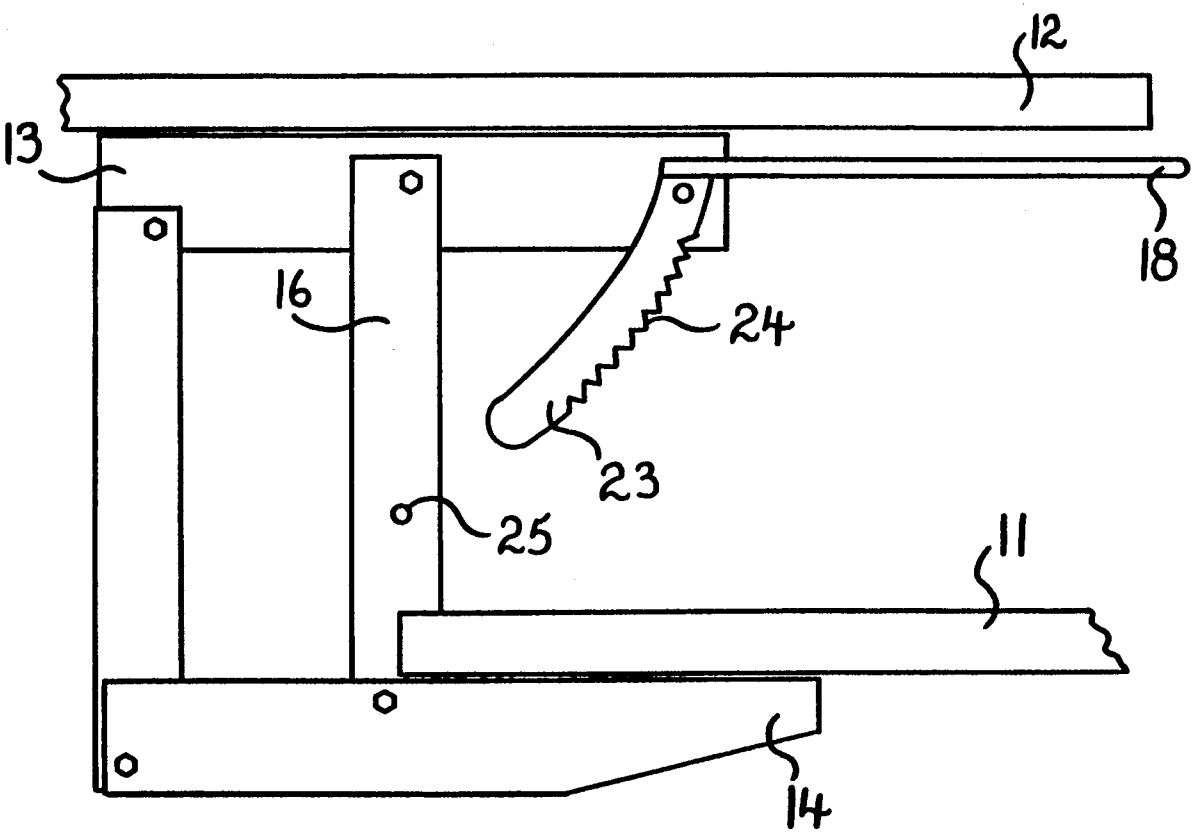
FIG. 6 is a side elevation of the third embodiment in the first position.

The third embodiment shown at FIGS. 5 and 6 again comprises a support platform 11 and a fixed member 12 of a similar form to that of the first and second embodiments. The locking means however, comprises an arcuate element 23 which is fixed at one end to the first member 13 to be pivotal thereon and is associated with a handle 18 which extends forwardly from the locking member underneath the fixed member 12 to be accessible from the front of the fixed member 12. The arcuate member 23 is formed along its curved surface with a serrated locking surface 19 and acts as a counterweight such that under the influence of gravity it will pivot forwardly (i.e. the handle will pivot upwardly) whereby the handle 18, unless otherwise restrained, will bear against the underneath of the fixed surface 16. The locking element 23 is associated with a fixed pawl member 25 in the form of a stop or abutment divided on the first link element 16 whereby for a range of positions including the second position of the support platform 11 the pawl member 25 is engagable with one of the notches 24 provided on the locking surface of the arcuate member 23. Due to the gravitational biasing provided by the counterweighting effect of the arcuate member 22 the locking member 23 is maintained in engagement with the pawl member 25. To effect disengagement therebetween, the operating handle 18 is pushed downwardly to bring the arcuate member 25 out of engagement with the pawl member.

The configuration of the teeth provided on the pawl member 17 and the locking surface 19 in each of the embodiments described above may be such that the support platform 11 can be raised from a locked position without the need to manipulate the locking member 18. When raised to a fresh position the support platform will be locked in that position. To the lower the support platform 11 it is necessary to raise the handle 18 to effect disengagement between the pawl member 17 and the locking surface 19.

The fourth, fifth, sixth and seventh embodiments which are shown at FIGS. 7 to 16 incorporate a locking means which does not necessitate the utilisation of a handle to effect disengagement or engagement between the pawl member and the locking surface. In each case the activation of the pawl member is effected through pivotal movement of the support platform with respect to the link elements. In each case by the upward pivotal movement of the support platform with respect to the fixed surface 12 the pawl member is disengaged from a locking surface which then allows for the adjustment of the height of the platform while the support platform is in the raised position and on return of the platform under the influence of gravity to its at rest position the pawl member is re-engaged with the locking surface over a range of movements.

Figure 7:
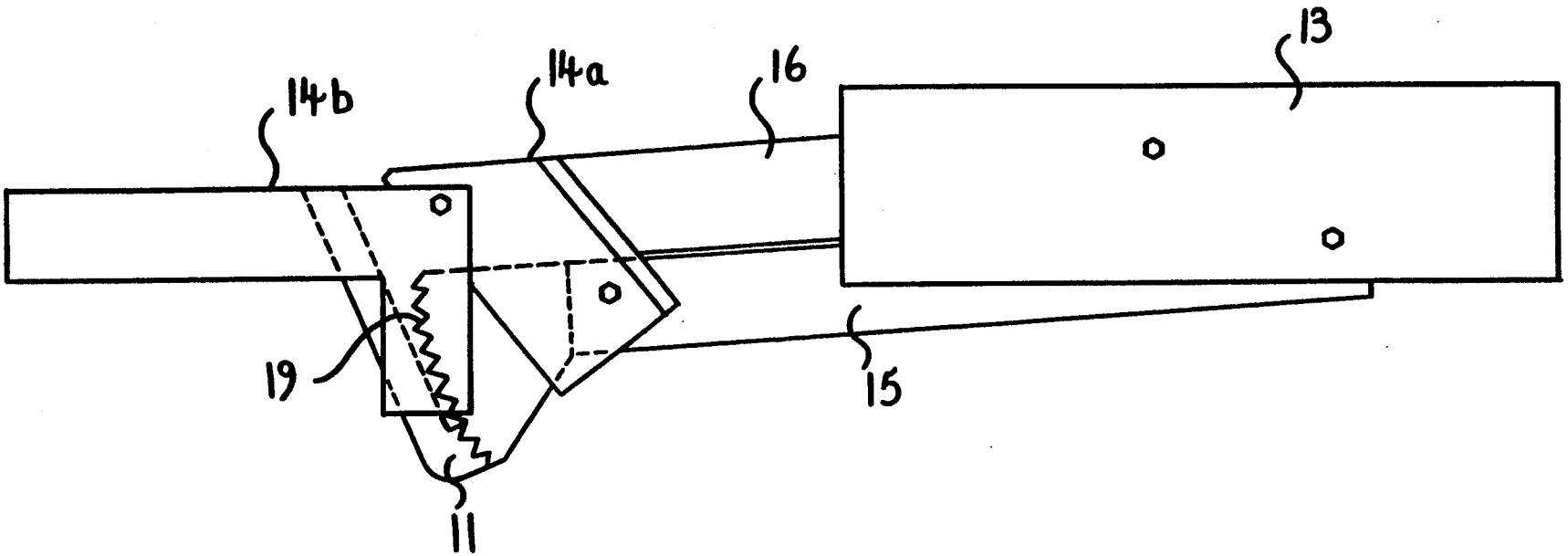
FIG. 7 is a side elevation of a fourth embodiment of the invention in its second position.
Figure 8:
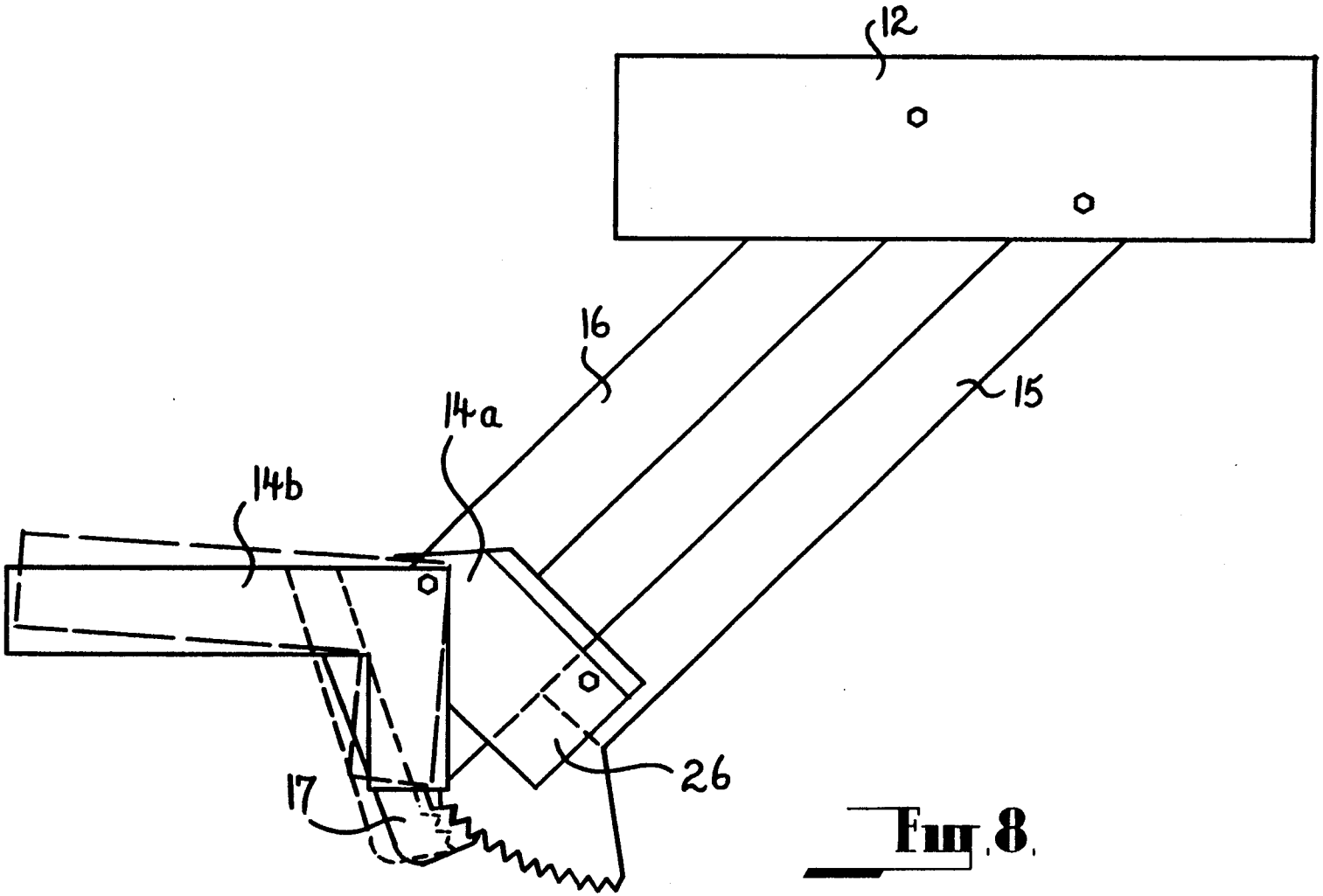
FIG. 8 is a side elevation of the fourth embodiment at an intermediate position between its first and second position.

In the fourth embodiment shown at FIGS. 7 and 8 the support platform 11 is supported from the fixed member 12 through a pair of pivotal links 15 and 16 as is the case in each of the previous embodiments. The second member however comprises a first portion **14*a*, which pivotally supports the ends of the link members and a second portion 14*b* is pivotally supported from the second member 14. As in the case of the first and second embodiments the serrated locking surface 19 is provided on the end of one of the link members 15 and the serrated pawl member 17 is supported from underneath the platform 11 and is engagable with the teeth of the locking surface 19. Under the influence of gravity the second portion 14*b* of the second member which supports the platform 11 will pivot on the first portion 14*a* of the second member to a position at which the teeth of the pawl member 17 and the locking surface 19 are interengaged. To effect disengagement between the pawl member 17 and the locking surface 19 the platform 11 is lifted at its outer edge to cause pivotal movement between the portions 14*a* and 14*b* of the second member and while in that position the platform 11 may be transposed vertically to the desired position. On lowering the outer edge of the platform the pawl member 17 is re-engaged with the locking surface 19 to retain the support platform in position. Any additional weight supported by the support platform 11** will only serve to enhance such engagement.

Figure 9:
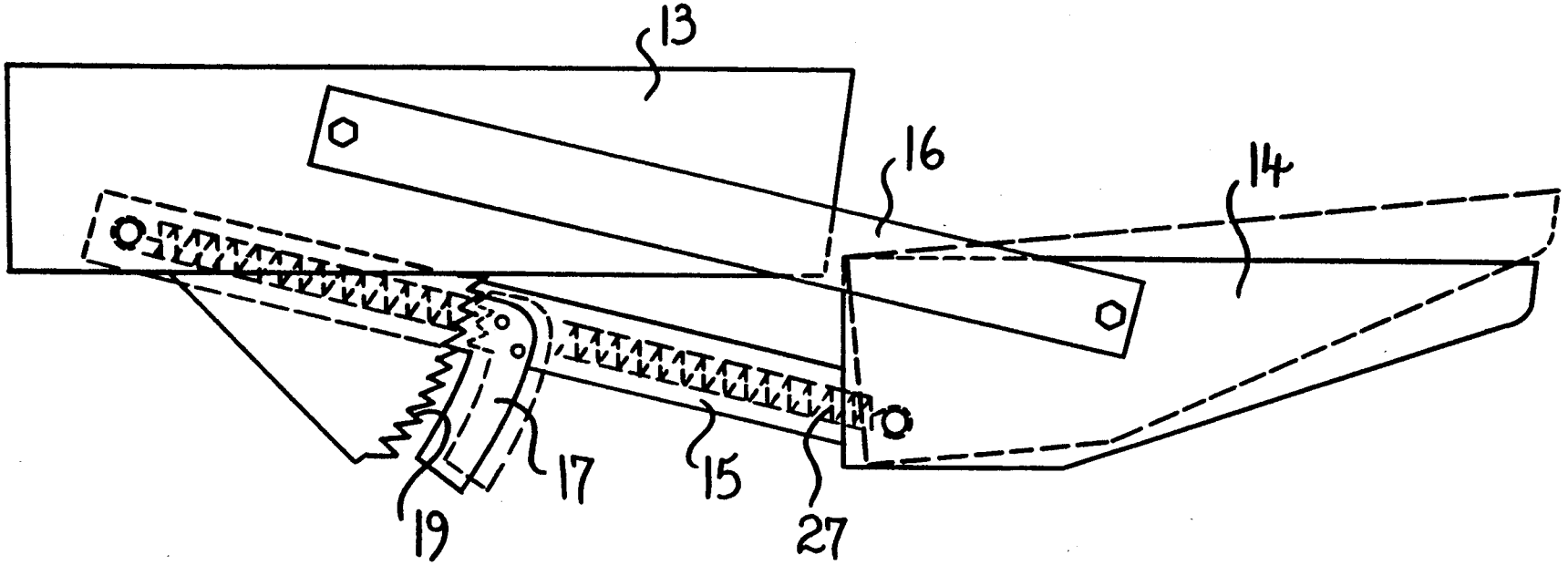
FIG. 9 is a side elevation of a fifth embodiment at or near its second position.
Figure 10:
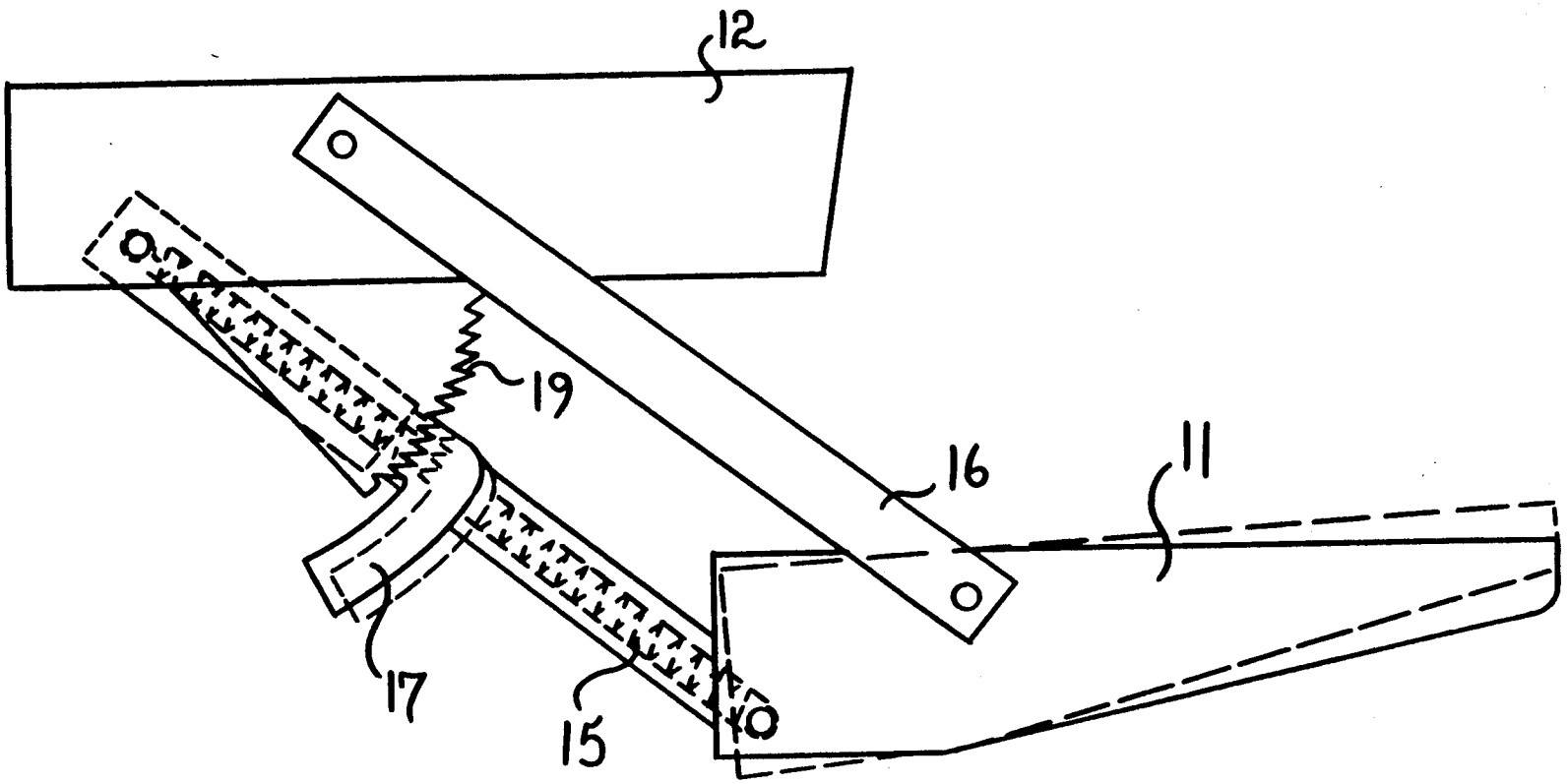
FIG. 10 is a side elevation of the fifth embodiment intermediate of the first and second position.

In the case of the fifth embodiment shown at FIGS. 9 and 10 the pivotal interconnection between the first member and the support platform 11 is similar to that of the first embodiment with the exception that the one link member 15 is telescopic in nature and is provided with a biassing means which can take the form of a spring 27 accommodated within the one link element between the pivotal mountings of the one link element to the first and second members 13 and 14. The spring 27 biasses the one link member to its minimum length. The locking surface 19 is mounted to the first member 13 and it is provided intermediate of the length of the one link member 15. The pawl member 17 is mounted to the one link member 15 such that it is biassed into engagement with the locking surface 19 as a result of the action of the spring 27. To effect disengagement between the pawl member 17 and the locking surface 19 the support platform 11 which is supported on the second member 14 is lifted at its outer edge to effect pivotal movement about the mounting of the second member to the other link member 16 which serves to extend the length of the one link member 15 and thus disengage the pawl member 17 from the locking surface 19. When the platform has been moved to its desired position with respect to the fixed support the outer edge of the support platform 11 is then lowered to effect re-engagement between the pawl member 17 and the locking surface 19.

Figure 11:
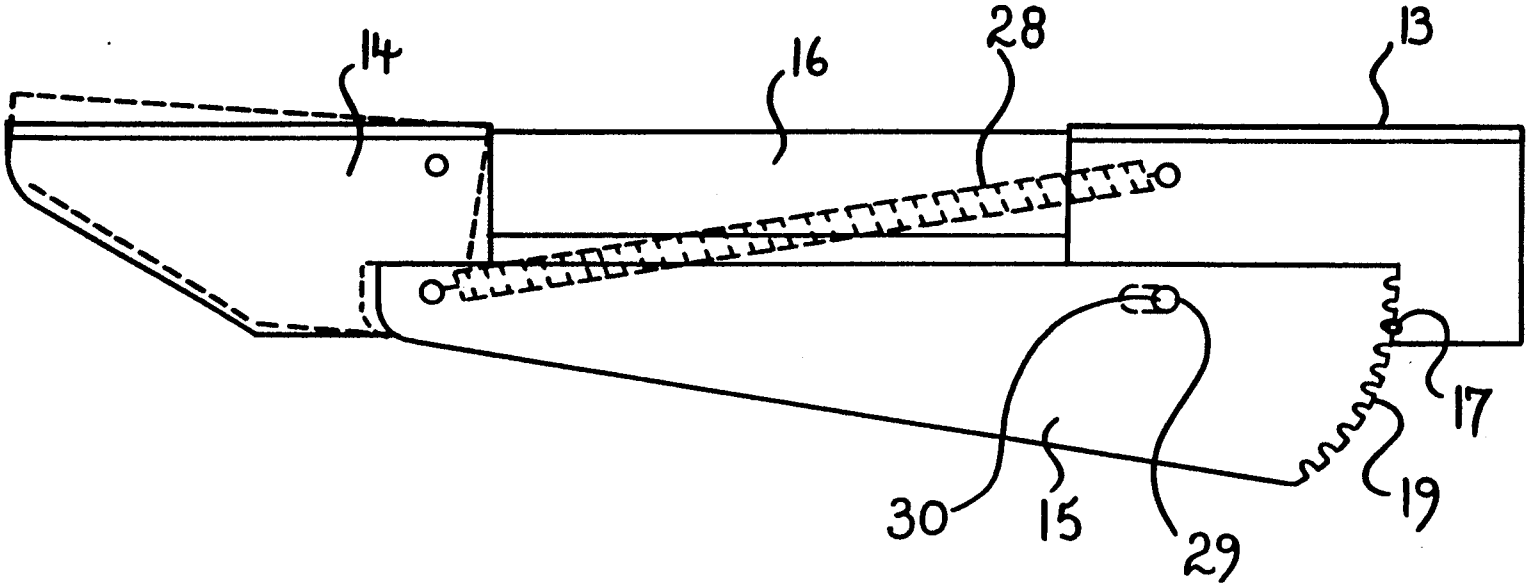
FIG. 11 is a side elevation of the sixth embodiment at its second position.
Figure 12:
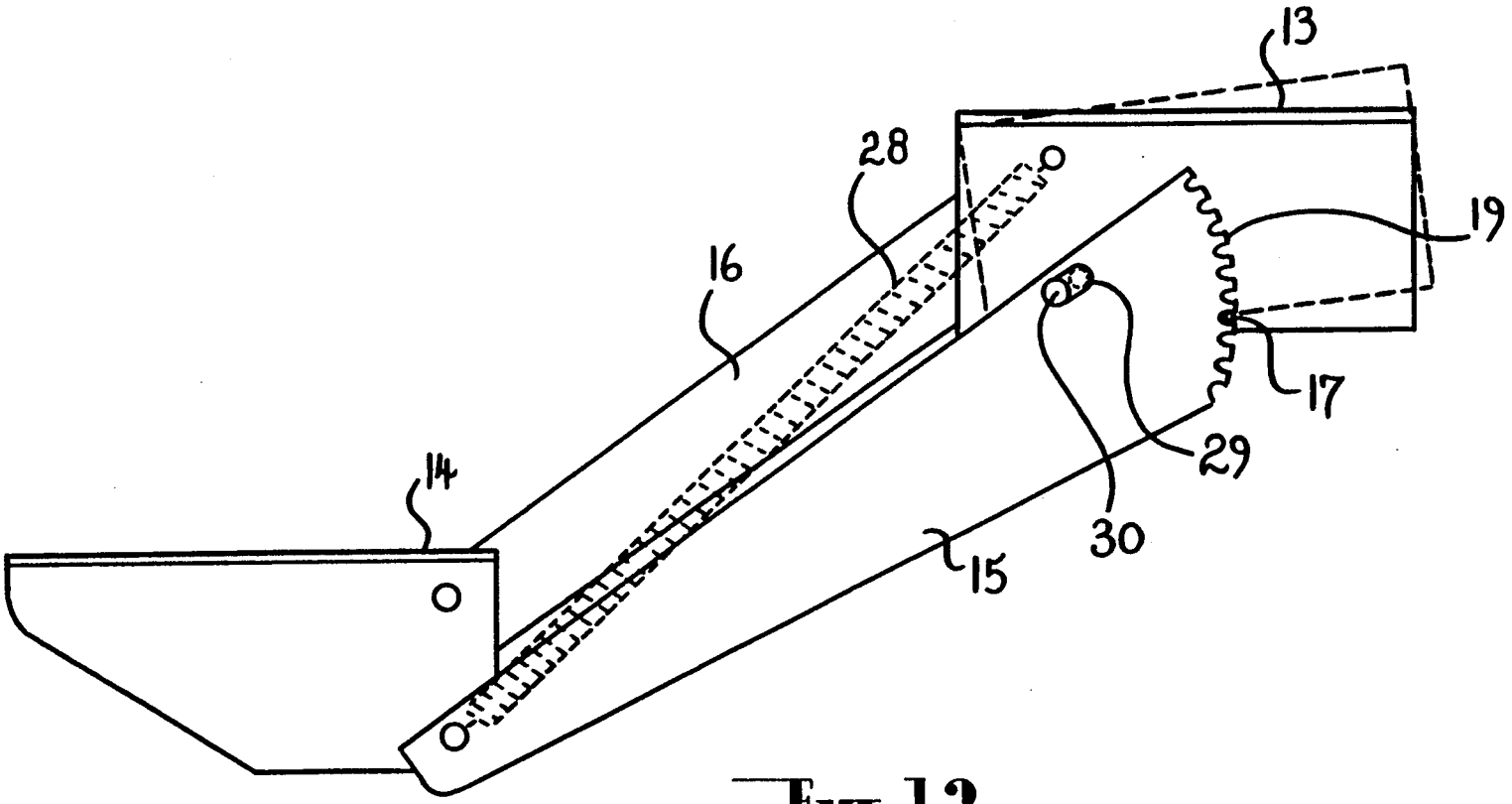
FIG. 12 is a side elevation of the sixth embodiment at a position intermediate its first and second position.

In the case of the sixth embodiment which is shown at FIGS. 11 and 12 the locking arrangement comprises a serrated locking surface 19 which is provided on the end of the one link element 15 adjacent the first member 13 while the pawl member comprises a fixed stop 17 which is provided on the first member 13. The pivot for the one link element 15 on the first member 13 comprises a pivot pin 30 which is receivable in an elongate slot 29. The axis of the elongate slot 29 is substantially parallel to the main axis of the one link member 15 and as a result of the engagement between the pivot pin 30 and the elongate slot 29 the second member 14 is capable of some relative pivotal movement on the other link member 16 which is independent of pivotal movement of the second member on the one link member 15. Therefore the one link member 15 is caused to move longitudinally on the pivot pin 30 by virtue of the elongate slot 29. A biassing spring 28 is provided between the first and second members 13 and 14 to extend between the pivot for the one link member 15 on the second member 14 and the pivot of the other link member 16 on the first member 13. As a result the one link member 15 is biassed to a position at which the pivot pin engages the end of the elongate slot closest to the second member 14 and as a result the locking surface 19 is biassed into engagement with the pawl member 17. On pivotal movement of the second member 14 about the pivot provided on the other link member 16, the one link member 15 is transposed with respect to the pivot pin 30 and as a result of such the locking surface 19 is brought out of engagement with the pawl member 17 which then allows for a height adjustment of the second member 14 relative to the first member 13.

Figure 13:
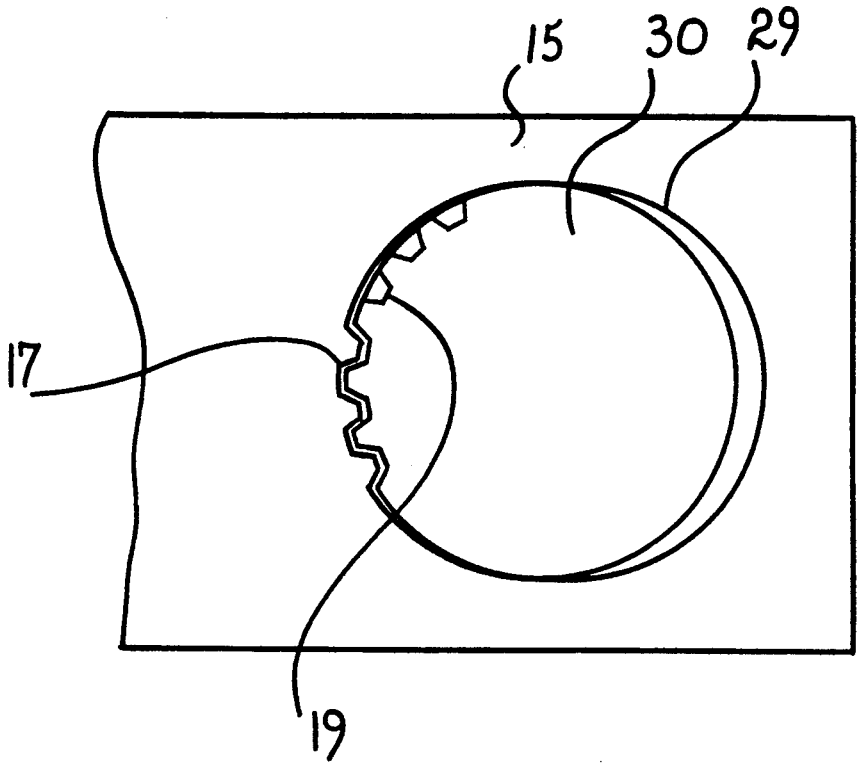
FIG. 13 is an enlarged view of an alternative arrangement between the pawl member and locking surface to be utilised with the sixth embodiment.

FIG. 13 discloses an alternative pivotal locking arrangement to that shown with respect to the sixth embodiment shown in FIGS. 11 and 12. As shown at FIG. 13 the pivot pin is of enlarged dimensions and is received in an elliptical aperture 29. The surfaces of the pivot pin 30 and elliptical slot 29 which are most adjacent to the second member 14 are formed with a complementary locking surface 19 and pawl member 17 respectively. The pivot pin is capable of radial transposition within the elliptical slot 29 and as a result of such transposition the locking surface 19 on the pivot pin 30 is disengaged from the pawl member.

Figure 14:
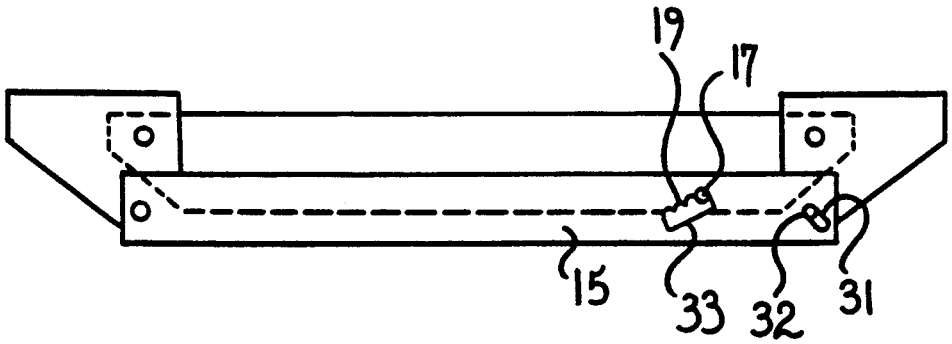
FIGS. 14, 15 and 16 are side elevations of the seventh embodiment in its first position; an adjusting position and second position respectively.
Figure 15:
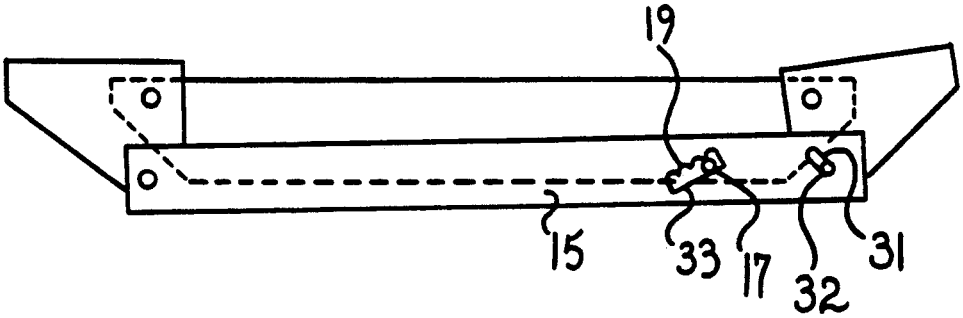
Figure 16:
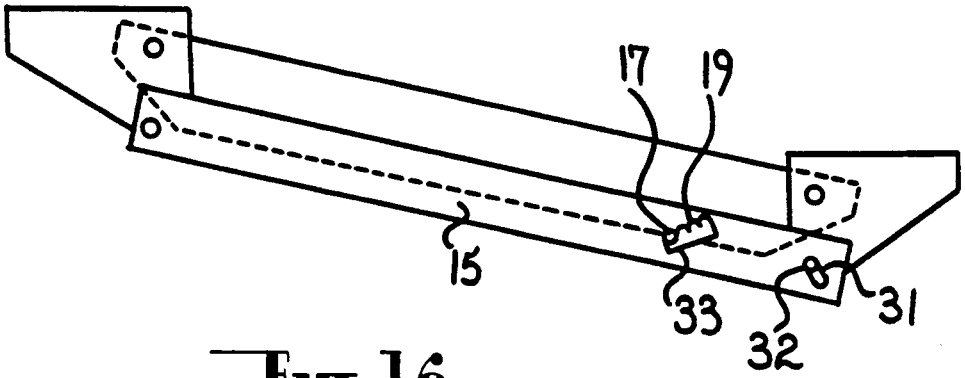

The seventh embodiment as shown at FIGS. 14, 15 and 16 provides a locking arrangement whereby the one and other link elements 15 and 16 are lockingly interengaged. The locking arrangement comprises an elongate slot 33 formed in the one link element 15 where the central axis of the slot is oblique to the central axis of the one link element 15. A notched locking surface 19 is provided along the length of one side of the slot. The slot 33 receives a pin supported from the other link element 16 and which comprises the fixed pawl member 17 and which is translatable along the length of the slot 33 but which is engagable with each of the notches provided in the locking surface 19. The location of the fixed pawl member 17 along the notched locking surface 19 determines the position of the second member 14 relative to the first member 13.

The second member 14 is supported from the link elements by means of a fixed pivot provided on the one link element 16 and a translatable pivot provided on the other link element 15. The translatable pivot comprises a second elongate slot 31 formed in the end of the one link element 15. The central axis of which is oblique to the central axis of the other link element 15 and in opposed orientation to that of the first slot 33 accommodating the locking surface 19. The translatable pivot further comprises a pivot pin 32 which is provided on the second member 14 and is translatable along the length of the second slot 31. When the second member 14 is pivoted on the other link element 16 without corresponding pivotal movement on the one link element 15 there is a transposition of the one link element 15 with respect to the other link member 16 which causes disengagement of the fixed pawl member 17 provided on the other link member 16 from the locking surface 19 provided in the first slot 33. As a result the second member 14 is then capable of vertical translation with respect to the first member 13 whereby the pawl 17 can move for the length of the first slot 11. A suitable biassing means is provided between the link members to bias the pawl member 17 into engagement with the locking surface 19. The biassing means can also serve to bias the platform towards an uppermost position whereby the biassing force may partially or completely overcome the influence of gravity.

Figure 17:
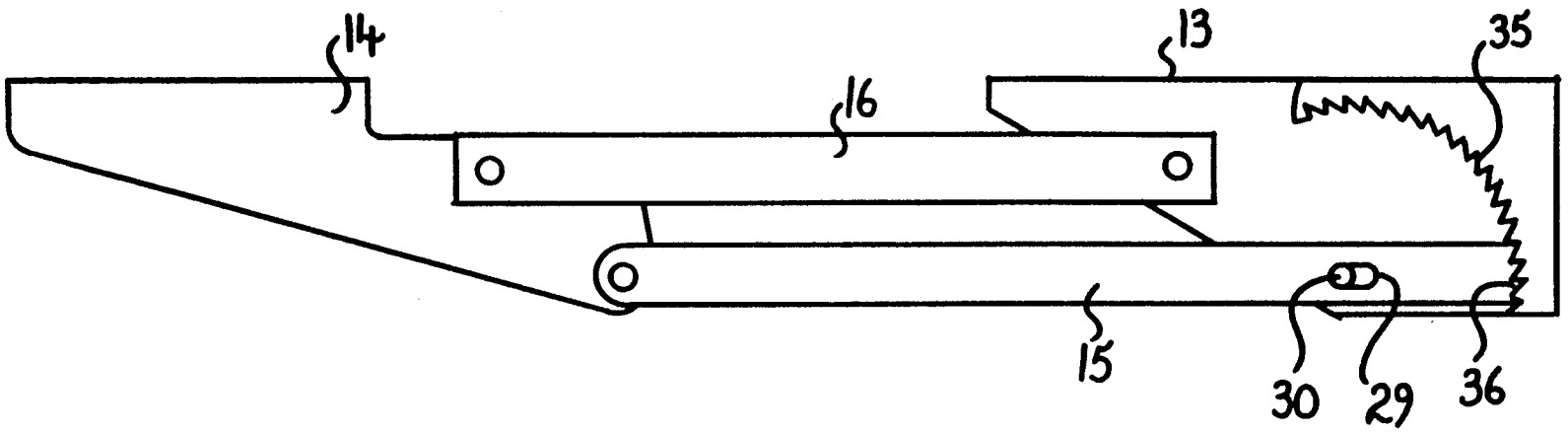
FIGS. 17, 18 and 19 are side elevations of the eighth embodiment in various positions.
Figure 18:
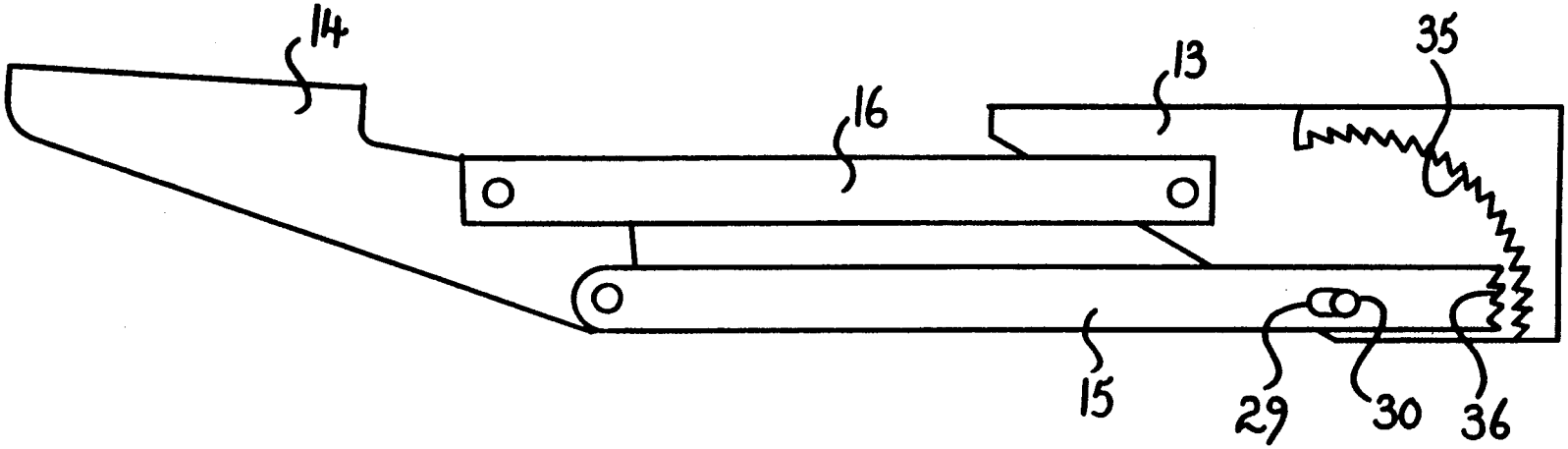
Figure 19:
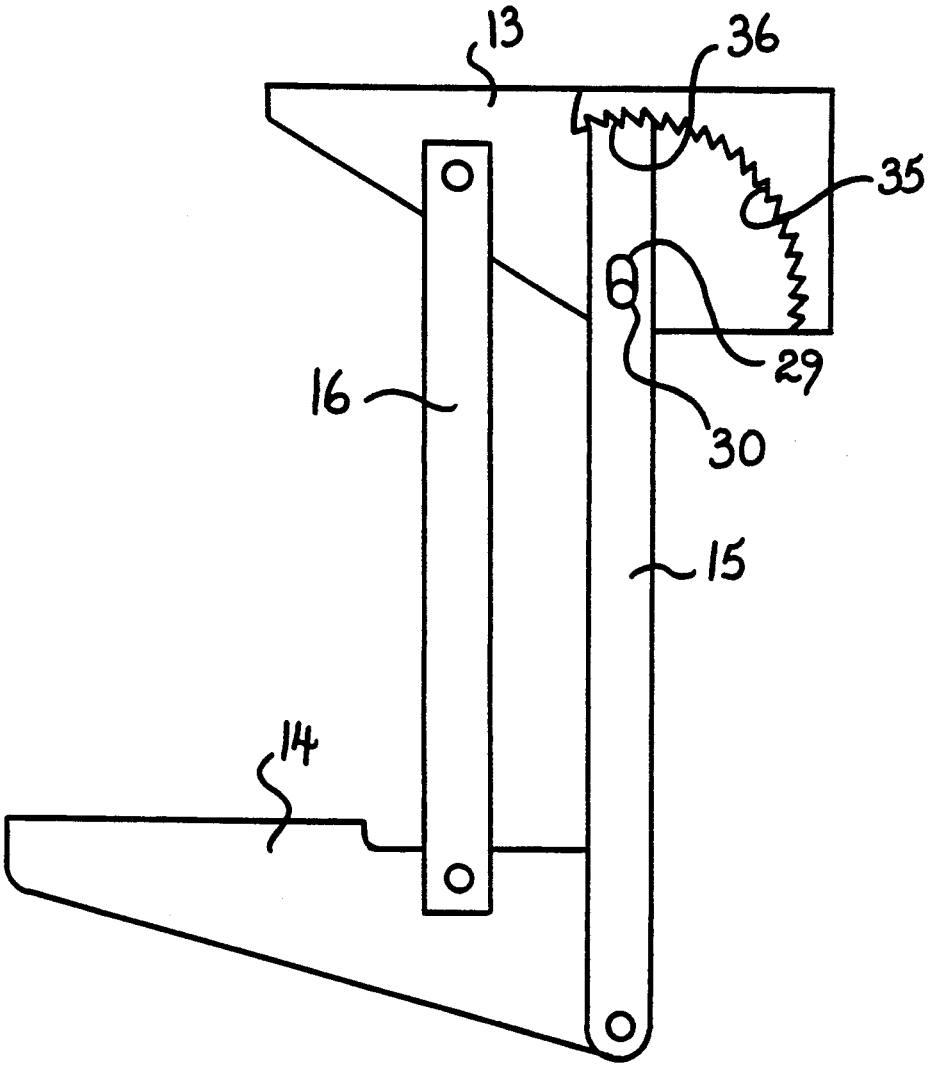

The eighth embodiment as shown at FIGS. 17, 18 and 19 is generally of a similar form to that of the sixth embodiment shown at FIGS. 11 and 12. The exception is that locking of the support platform is effected by an arcuate concave serrated surface 35 which is supported on the first member and a serrated formation 36 on the end of the one link member 15 most adjacent the serrated surface 35. In addition there is no need for spring biassing to retain the locking surfaces in engagement since the weight of the second member 14 and the support platform will bias the surfaces into engagement.

Figure 20:
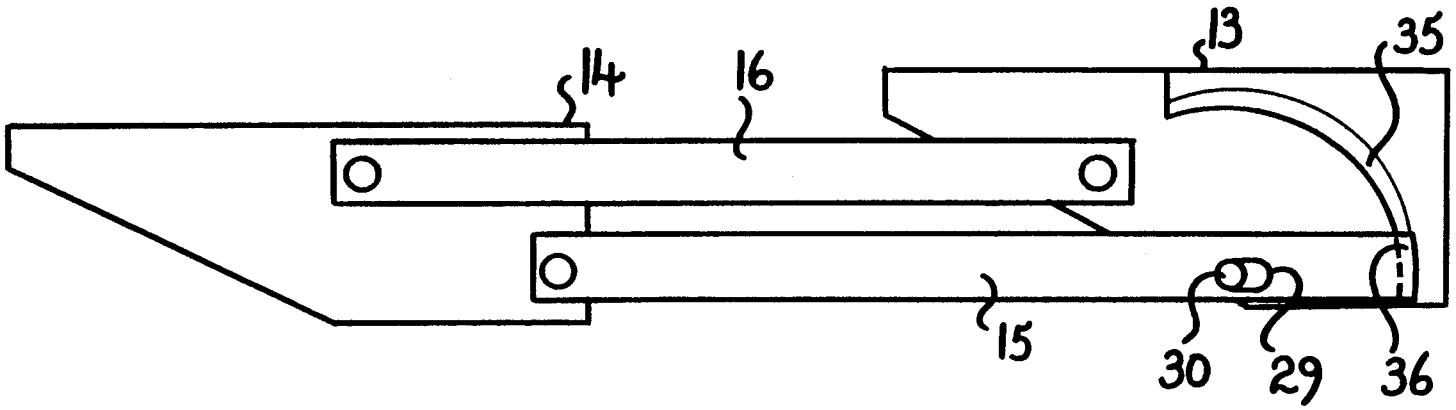
FIGS. 20 and 21 are side elevations of the ninth embodiment with the elements in the locked and unlocked positions respectively.
Figure 21:
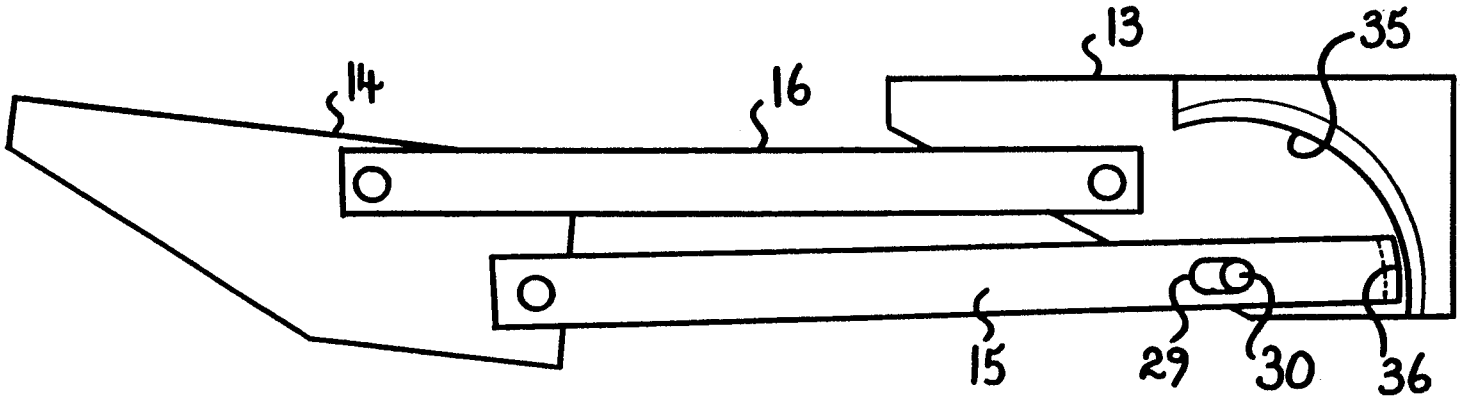
Figure 22:
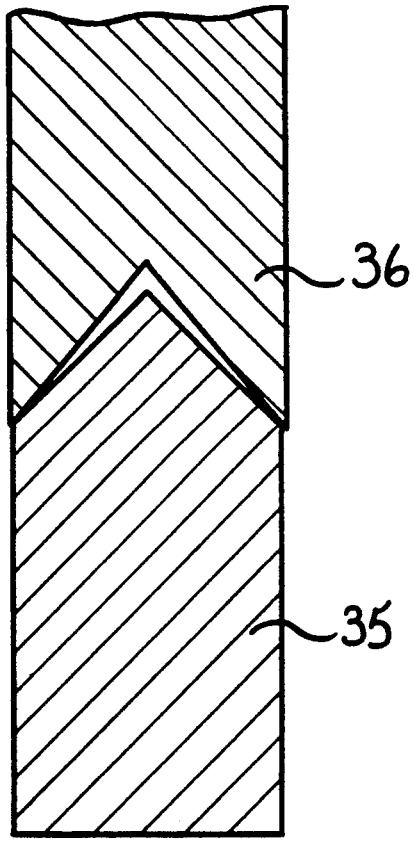
FIG. 22 is a part sectional view of the locking members of the ninth embodiment.

The ninth embodiment shown at FIGS. 20, 21 and 22 is of very similar form to the eighth embodiment of FIGS. 19, 20 and 21. The exception provided by the ninth embodiment however relates to the nature of the locking inter-engagement between the locking surfaces. In previous embodiments the locking inter-engagement is effected through complementary serrated formation provided on the opposed locking surfaces. In the case of the ninth embodiment the locking surfaces are frictionally inter-engaged.

As shown at FIG. 22 the arcuate locking surface 35 has a convex V-shaped profile while the adjacent end 36 of the one link member is formed with a V shaped groove which is receivable over the arcuate locking surface. In addition the degree of divergence of the convex surface of the arcuate locking surface 35 is greater than that of the groove on the one link element 15. On inter-engagement between the surfaces as a result of the weight of the links 15 and 16 beyond their pivotal connection to the first member 15, the weight of the second member 14 and the weight of the support platform and its contents, the surfaces become intimately interengaged and the groove at the one link member 15 is wedged over the locking surface. This wedging action increases as the weight on the support platform is increased and thus the retention of the support platform in position is enhanced. However by lifting the outer edge of the support platform the locking surfaces are readily disengaged.

In each of the fourth, fifth, sixth, seventh and eighth embodiments the teeth may be formed such that the platform can be raised without positive disengagement of the teeth resulting from movement of the outer edge of the platform upwardly but such that positive disengagement is required to move the platform downwardly. In addition the locking engagement between the locking surfaces may be associated with any of the elements to effect the desired locking action. Furthermore the locking interengagement between the locking member may take any form appropriate to the circumstances and need not be restricted to the two particular forms of locking inter engagement described in relation to the above embodiments.

It should be appreciated that the scope of the present invention need not be limited to the particular scope of the embodiments described above.

The claims defining the invention are as follows; I claim:

1. A support means for supporting a support platform from a fixed base whereby the support platform is movable between a first position at least partially below the fixed base and a second position in front of the fixed base, said support means comprising a first element adapted to be mounted to the support platform, a second element adapted to be affixed to said fixed base, a pair of linkage elements each pivotally fixed at one end to said first element at spaced intervals on said first element and each pivotally mounted at the other end to said second element at spaced locations spaced on said second element for movement of the support platform between the first and second positions and throughout such movement the attitude of said support platform remains substantially constant, said support means further comprising a locking means for locking said support platform in a range of positions including said second position, said locking means comprising a first locking member supported on one of said elements and having a first engagement face engagable with a second engagement face provided on a second locking member provided on another of said elements, said locking members being moveable relative to each other upon the exertion of a force to one of these two elements for moving said locking members to a released position at which the engagable faces are disengaged for subsequent movement of said support platform relative to said base to any of a plurality of desired positions, release of the force being effective to cause said engagement faces to re-engage to retain said second element relative to said first element in the desired positions.

2. A support means as claimed in claim 1 wherein the locking members are gravitationally biased into locking engagement with each other.

3. A support means as claimed at claim 1 wherein one of the locking members is serrated.

4. A support means as claimed at claim 2 wherein one of the locking members is serrated.

5. A support means as claimed at claim 1 wherein locking members are adapted to be frictionally interengagable when engaged with each other.

6. A support means as claimed at claim 2 wherein the locking members are adapted to be frictionally interengagable when engaged with each other.

7. A support means as claimed at claim 1 wherein the pivotal connection of one link element to one of said first and second elements is displaceable longitudinally from the pivotal connection of the one link element with the other of said elements, said first locking member being provided on said one link element and said second locking member being provided on the other of said elements, such longitudinal displacement being effective to move said locking members between their released and locked positions.

8. A support means as claimed at claim 7 wherein said one link member is telescopic in length.

9. A support means as claimed at claim 7 wherein the pivotal mounting of the one link element to the first element is provided by an elliptical or elongate aperture in one element and a pivot pin of the other element which is slidably and pivotally received in the elliptical or elongate slot.

10. A support means as claimed in claim 1 wherein said second element comprises a first portion interconnecting the other end of the link elements and a second portion pivotally supported from the first portion and supporting one of the locking members.

11. A support means as claimed at claim 2 wherein the pivotal connection of one link element to one of said first and second elements is displaceable longitudinally from the pivotal connection of the one link element with the other of said elements, said first locking member being provided on said one link element and said second locking member being provided on the other of said elements, such longitudinal displacement being effective to move said locking members between their released and locked positions.

12. A support means as claimed at claim 11 wherein said one link member is telescopic in length.

13. A support means as claimed at claim 11 wherein the pivotal mounting of the one link element to the first element is provided by an elliptical or elongate aperture in one element and a pivot pin of the other element slidably received in the elliptical or elongate slot.

14. A support means as claimed at claim 2 wherein one of said first element and said second element comprises a first portion interconnecting the other end of the link elements and a second portion pivotally supported from the first portion and supporting one of the locking members.

15. A support means as claimed at claim 14 wherein the other of the locking members is affixed to the one of the link elements.

16. A support means as claimed at claim 4 wherein the pivotal connection of one link element to one of said first and second elements is displaceable longitudinally from the pivotal connection of the one link element with the other of said elements, said first locking member being provided on said one link element and said second locking member being provided on the other of said elements, such longitudinal displacement being effective to move said locking members between their released and locked positions.

17. A support means as claimed at claim 16 wherein said one link member is telescopic in length.

18. A support means as claimed at claim 16 wherein the pivotal mounting of the one link element to the first element is provided by an elliptical or elongate aperture in one element and a pivot pin of the other element slidably received in the elliptical or elongate slot.

19. A support means as claimed at claim 6 wherein the pivotal connection of one link element to one of said first and second elements is displaceable longitudinally from the pivotal connection of the one link element with the other of said elements, said first locking member being provided on said one link element and said second locking member being provided on the other of said elements, such longitudinal displacement being effective to move said locking members between their released and locked positions.

20. A support means as claimed at claim 19 wherein said one link member is telescopic in length.

21. A support means as claimed at claim 19 wherein the pivotal mounting of the one link element to the first element is provided by an elliptical or elongate aperture in one element and a pivot pin of the other element slidably received in the elliptical or elongate slot.

22. A support means as claimed at claim 6 wherein the one engagement face has a convex V-shaped profile and the other engagement face has a concave V-shaped profile.

23. A support means as claimed at claim 22 wherein the divergence of the V-shaped profile of the one face is less than the divergence of the V-shaped profile of the other face.

24. A support means as claimed at claim 11 wherein the one engagement face has a convex V-shaped profile and the other engagement face has a concave V-shaped profile.

25. A support means as claimed at claim 24 wherein the divergence of the V-shaped profile of the one face is less than the divergence of the V-shaped profile of the other face.

26. A support means as claimed at claim 5 wherein the one engagement face has a convex V-shaped profile and the other engagement face has a concave V-shaped profile.

27. A support means as claimed at claim 26 wherein the divergence of the V-shaped profile of the one face is less than the divergence of the V-shaped profile of the other face.

28. A support means as claimed at claim 13 wherein the one engagement face has a convex V-shaped profile and the other engagement face has a concave V-shaped profile.

29. A support means as claimed at claim 28 wherein the divergence of the V-shaped profile of the one face is less than the divergence of the V-shaped profile of the other face.

30. A support means as claimed at claim 19 wherein the one engagement face has a convex V shaped profile and the other engagement face has a concave V-shaped profile.

31. A support means as claimed at claim 30 wherein the divergence of the V-shaped profile of the one face is less than the divergence of the V-shaped profile of the other face.

32. A support means as claimed at claim 21 wherein the one engagement face has a convex V-shaped profile and the other engagement face has a concave V-shaped profile.

33. A support means as claimed at claim 32 wherein the divergence of the V-shaped profile of the one face is less than the divergence of the V shaped profile of the other face.

34. A support means as claimed at claim 5 wherein the first locking member is provided on one link element and the second locking member is provided on one of the first or second elements, the pivotal connection of one link element to the one of said first and second elements is displaceable longitudinally from the pivotal connection of the one link element with the other of said first or second elements.

35. A support means as claimed at claim 34 wherein said one link member is telescopic in length.

36. A support means as claimed at claim 35 wherein the pivotal mounting of the one link element to the one of the first or second elements is provided by an elliptical or elongate aperture in one element and a pivot pin of the other element slidably received in the elliptical or elongate slot.

37. A support means as claimed at claim 34 wherein the one engagement face has a convex V-shaped profile and the other engagement face has a concave V-shaped profile.

38. A support means as claimed at claim 37 wherein the divergence of the V-shaped profile of the one face is less than the divergence of the V-shaped profile of the other face.

39. A support means as claimed at claim 3 wherein the first locking member is provided on one link element and the second locking member is provided on one of the first or second elements, the pivotal connection of one link element to the one of said first and second elements is displaceable longitudinally from the pivotal connection of the one link element with the other of said first or second elements.

40. A support means as claimed at claim 39 wherein one link member is telescopic in length.

41. A support means as claimed at claim 39 wherein the pivotal mounting of the one link element to the one of the first or second elements is provided by an elliptical or elongate aperture in one element and a pivot pin of the other element slidably received in the elliptical or elongate slot.

42. A support means as claimed at claim 39 wherein the one engagement face has a convex V-shaped profile and the other engagement face has a concave V-shaped profile.

43. A support means as claimed at claim 42 wherein the divergence of the V-shaped profile of the one face is less than the divergence of the V-shaped profile of the other face.

44. A support means as claimed at claim 10 wherein the one engagement face has a convex V-shaped profile and the other engagement face has a concave V-shaped profile.

45. A support means as claimed at claim 44 wherein the divergence of the V-shaped profile of the one face is less than the divergence of the V-shaped profile of the other face.

46. A support means for supporting a support platform from a fixed base whereby the support platform is movable between a first position at least partially below the fixed base and a second position in front of the fixed base, said support means comprising a first element adapted to be mounted to the support platform, a second element adapted to be affixed to said fixed base, a pair of linkage elements each pivotally fixed at one end to said first element at spaced intervals on said first element and each pivotally mounted at the other end to said second element at spaced locations spaced on said second element to enable movement of the support platform between the first and second positions whereby throughout such movement the attitude of said support platform remains substantially constant, said support means further comprising a locking means for locking said support platform in a range of positions including said second position, said locking means comprising a first locking member supported on one of said linkage elements and having a first engagement face engagable with a second engagement face provided on a second locking member provided on another of said elements said locking members being relatively moveable between a released position at which the engagable faces are disengaged to allow movement of said support platform relative to said base and gravitationally biased into a plurality of locking positions at which the engagement faces are engaged to retain said second element relative to said first element in one of said range of positions, at least one of said locking members being serrated.

47. A support means as claimed at claim 46 wherein the pivotal connection of one link element to one of said first and second elements is displaceable longitudinally from the pivotal connection of the one link element with the other of said elements such longitudinal displacement being effective to move said locking members between their released and locked positions.

48. A support means as claimed at claim 47 wherein said one link member is telescopic in length.

49. A support means as claimed at claim 47 wherein the pivotal mounting of the one link element to the first element is provided by an elliptical or elongate aperture in one element and a pivot pin of the other element slidably received in the elliptical or elongate slot.

50. A support means as claimed at claim 47 wherein the one locking member is affixed to the one link element.

51. A support means as claimed at claim 50 wherein the other locking member is fixed to one of the first and second elements.

52. A support means as claimed at claim 51 wherein the one of the first and second elements comprises the element to which the longitudinally displaceable pivotal connection is provided.

* * * * *

US005292097C1

(12) EX PARTE REEXAMINATION CERTIFICATE (6393rd)

United States Patent

Russell

(10) Number: US 5,292,097 C1

(45) Certificate Issued: Aug. 26, 2008

(54) WORK SURFACE SUPPORT

(75) Inventor: Edwin R. Russell, Cottesloe (AU)

(73) Assignee: Softview Computer Products Corp., New York, NY (US)

Reexamination Request:
No. 90/007,256, Oct. 13, 2004

Reexamination Certificate for:

| | |
|---|---|
| Patent No.: | **5,292,097** |
| Issued: | **Mar. 8, 1994** |
| Appl. No.: | **07/907,483** |
| Filed: | **Jul. 1, 1992** |

Related U.S. Application Data

(63) Continuation-in-part of application No. 07/607,448, filed on Oct. 31, 1990, now abandoned.

(30) Foreign Application Priority Data

Oct. 31, 1989 (AU) ..... PJ7143

(51) Int. Cl.
*F16M 11/00* (2006.01)

(52) U.S. Cl. ..... 248/281.11; 248/918

(58) Field of Classification Search ..... 211/172–174; 248/276.1, 281.11, 282.1–287.1, 581, 674, 248/918, 919; 312/27, 319.2, 319.4, 324, 312/325; 400/682

See application file for complete search history.

(56) References Cited

U.S. PATENT DOCUMENTS

| | | | | |
|---|---|---|---|---|
| 213,775 | A | 4/1879 | Rednan et al. | |
| 420,069 | A * | 1/1890 | Hood et al. | 248/281.11 |
| 651,539 | A | 6/1900 | Warren | |
| 790,207 | A * | 5/1905 | Bultman | 248/281.11 |
| 1,037,627 | A | 9/1912 | Hunter | |
| 1,122,372 | A | 12/1914 | Duncan | |
| 1,176,272 | A * | 3/1916 | Holtz | 248/281.11 |
| 1,392,744 | A | 10/1921 | Clough | |
| 1,491,781 | A | 4/1924 | Axen | |
| 1,532,715 | A | 4/1925 | Petrarca | |
| 1,606,975 | A | 11/1926 | Tobey | |
| 1,893,624 | A | 1/1933 | Jay | |
| 1,929,048 | A | 10/1933 | Ash | |
| 2,001,507 | A | 5/1935 | Stribling | |
| 2,258,782 | A | 10/1941 | McKean | |
| 2,287,577 | A | 6/1942 | Stava | |
| 2,541,075 | A | 2/1951 | Koch | |
| 2,678,862 | A | 5/1954 | Paliuca | |
| 2,822,229 | A | 2/1958 | Carlson | |
| 3,000,606 | A | 9/1961 | Storm | |
| 3,003,838 | A | 10/1961 | Chaft | |
| 3,079,726 | A | 3/1963 | May | |
| 3,122,348 | A | 2/1964 | Wilkinson | |
| 3,311,340 | A | 3/1967 | Riis | |
| 3,396,931 | A | 8/1968 | Eckstein | |

(Continued)

FOREIGN PATENT DOCUMENTS

| | | |
|---|---|---|
| AU | 107349 | 5/1939 |
| AU | 159220 | 8/1953 |
| AU | 48536/59 | 11/1959 |

(Continued)

OTHER PUBLICATIONS

Installation, Operation and Office Maintenance Manual for the Weber Wall Un–ette Model P–70, Dec. 1970, Publication No. SS1457–3 Entire Manual, The Weber Dental Manufacturing Company, Canton, OH.

(Continued)

*Primary Examiner*—Jimmy G. Foster

(57) ABSTRACT

A number of embodiments of supports for supporting a support platform for movement relative to a base in a generally parallel orientation through a plurality of positions. The support includes a pair of parallel lengths pivotally connected at their ends to the support platform and the base. A locking mechanism is provided for locking the support platform in any of a plurality of positions and this locking mechanism includes serration formed on one of the support lengths and a cooperating locking member carried by one of the other elements.

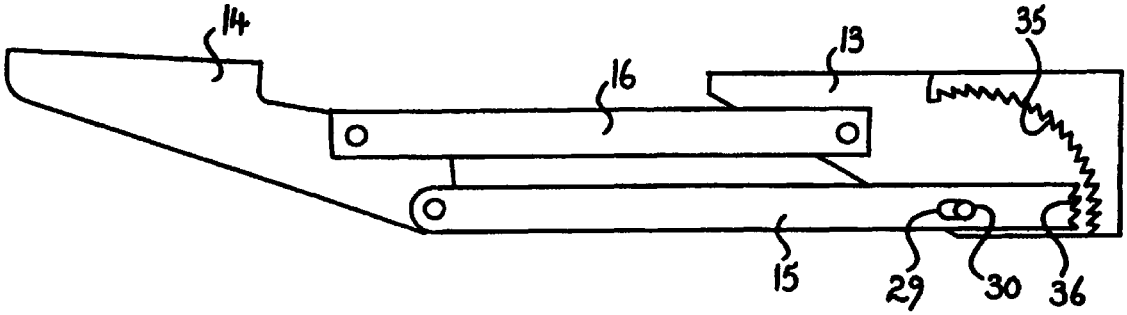

U.S. PATENT DOCUMENTS

| | | | |
|---|---|---|---|
| 3,409,261 | A | 11/1968 | Leporati |
| 3,425,761 | A | 2/1969 | Schreyer |
| 3,433,444 | A | 3/1969 | Smith |
| 3,436,046 | A | 4/1969 | Valeska |
| 3,490,727 | A | 1/1970 | Miller |
| 3,516,343 | A | 6/1970 | Tunney |
| 3,550,976 | A | 12/1970 | Rauser |
| 3,667,714 | A | 6/1972 | Ziaylek |
| 3,698,780 | A | 10/1972 | Collins |
| 3,762,051 | A | 10/1973 | Valeska |
| 3,765,676 | A | 10/1973 | Bearson et al. |
| 3,866,866 | A | 2/1975 | Kneile |
| 3,995,797 | A | 12/1976 | Knight |
| 4,082,244 | A | 4/1978 | Groff |
| 4,118,766 | A | 10/1978 | Kredo |
| 4,213,591 | A | 7/1980 | Jaakkola |
| 4,266,747 | A | 5/1981 | Souder |
| 4,382,642 | A | 5/1983 | Burdick |
| 4,384,532 | A | 5/1983 | Staff |
| 4,447,031 | A | 5/1984 | Souder |
| 4,496,200 | A | 1/1985 | Hagstrom et al. |
| 4,515,086 | A | 5/1985 | Kwiecinski et al. |
| 4,568,052 | A | 2/1986 | Solomon et al. |
| 4,616,798 | A | 10/1986 | Smeenge et al. |
| 4,625,657 | A | 12/1986 | Little et al. |
| 4,640,062 | A | 2/1987 | Rubik |
| 4,644,875 | A | 2/1987 | Watt |
| 4,706,919 | A | 11/1987 | Soberalski et al. |
| 4,776,284 | A | 10/1988 | McIntosh |
| 4,826,123 | A | 5/1989 | Hannah et al. |
| 4,834,329 | A | 5/1989 | Delapp |

FOREIGN PATENT DOCUMENTS

| | | |
|---|---|---|
| AU | 48536/76 | 11/1959 |
| AU | 32032/77 | 7/1979 |
| AU | 51583/79 | 4/1981 |
| AU | 10051/83 | 10/1983 |
| AU | 21793/83 | 6/1984 |
| AU | 28074/84 | 11/1984 |
| AU | 39874/85 | 9/1985 |
| AU | 581471 | 3/1986 |
| AU | 92378 | 6/1986 |
| AU | 92379 | 6/1986 |
| AU | 75700/87 | 1/1988 |
| AU | 592229 | 3/1988 |
| AU | 19015/88 | 1/1989 |
| AU | 21786/88 | 3/1989 |
| AU | 38179/89 | 1/1990 |
| AU | 65578/90 | 5/1991 |
| AU | 69134/91 | 7/1991 |
| AU | 41393/89 | 8/1991 |
| CH | 99489 | 6/1923 |
| CH | 162103 | 8/1933 |
| CH | 255365 | 1/1949 |
| CH | 286429 | 2/1953 |
| DE | 880794 | 6/1953 |
| DE | 20 30 522 | 12/1971 |
| DE | 24 39 687 | 3/1976 |
| DE | 25 24 019 | 12/1976 |
| DE | 79 08 089 | 6/1979 |
| GB | 841552 | 7/1960 |
| WO | WO 85/02524 | 6/1985 |

OTHER PUBLICATIONS

DE Berichte, Dental Echo, Feb. 1981, vol. 1, 1981, pp. 26–38 Helmut Haase Verlag, Heidelberg, Germany.

Dental Products Report, Doctor's Console, Jul./Aug. 1980, cover page, vol. 14, No. 7, Thomas D. Hoyt, DDS, Skokie, IL.

Cakir, A., Visual Display Terminals, 1980, pp. 159–163, John Wiley & Sons, Chichester, England.

Galitz, W.O., Human Factors in Office Automation, pp. 80–81, 183–189, Life Office Management Association, Atlanta, GA 1980.

Scenes from an International Fair, Modern Office Procedures, Feb. 1981, pp. 150–151, 155, vol. 26, No. 2, Penton Inc., Waseca, MN.

Weber Wall–Un–ette P–70 sales brochure, 1968, The Weber Dental Manufacturing Co., Canton, OH.

Dental Equipment Catalog, 1968, The Weber Dental Manufacturing Co., Canton, OH.

Unitek Electronics Support by Haworth, 1982, Haworth Inc., Holland, MI.

Paul, E., Ergonomics: The design of the dental surgery and its equipment, Oral Health, Aug. 1975, pp. 30–37, vol. 65, No. 8, Southam Business Publications Ltd., Don Mills, Ontario, Canada.

Sherwin, A., Equipment for Low–seated Dentistry, The Dental Magazine, Dec. 1968, pp. 249–251, 261, vol. 85, No. 6, England.

McCormick, Ernest, J., Human Factors Engineering, 2d Ed. pp. 362–377, McGraw–Hill, Inc., 1964.

Interiors, Second Book of Offices, 96–97, 183–185, 246–249, 252 (John Pile, ed., Whitney Library of Design, 1969).

Judy Graf Klein, The Office Book, pp. 24–25, 38–39, 101, 114–115, 142–143 and 194–195, John Smallwood, ed., Quarto Marketing Ltd., 1982.

Pelton & Crane, The Exec–Aire, Proofs, Apr. 1980, unnumbered page (1980).

Advertisement, Gifts for Your Car, Motor Trend, Dec. 1953, p. 46, R. E. Peterson, Los Angeles, CA.

Ritter Super Starlite Dental Operating Light, 1980, Sybron Ritter Dental Products Division, Romulus, MI.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 5, 16, 19, 30–33, 39 and 46 are cancelled.

Claims 3, 4, 6, 7, 10, 11, 14, 17, 18, 20, 21, 26, 34, 40–42 and 47 are determined to be patentable as amended.

Claims 8, 9, 12, 13, 15, 22–25, 27–29, 35–38, 43–45 and 48–52 dependent on an amended claim, are determined to be patentable.

3. A support means as claimed at claim [1] *11* wherein one of the locking members is serrated.

4. A support means as claimed at claim [2] *7* wherein one of the locking members is serrated.

6. A support means as claimed at claim [2] *11* wherein the locking members are adapted to be frictionally interengagable when engaged with each other.

7. A support means [as claimed at claim 1] *for supporting a support platform from a fixed base whereby the support platform is movable between a first position at least partially below the fixed base and a second position in front of the fixed base, said support means comprising a first element adapted to be mounted to the support platform, a second element adapted to be affixed to said fixed base, a pair of linkage elements each pivotally fixed at one end to said first element at spaced intervals on said first element and each pivotally mounted at the other end to said second element at spaced locations spaced on said second element for movement of the support platform between the first and second positions and throughout such movement the attitude of said support platform remains substantially constant, said support means further comprising a locking means for locking said support platform in a range of positions including said second position, said locking means comprising a first locking member supported on one of said elements and having a first engagement face engagable with a second engagement face provided on a second locking member provided on another of said elements, said locking members being movable relative to each other upon the exertion of a force to one of these two elements for moving said locking members to a released position at which the engagable faces are disengaged for subsequent movement of said support platform relative to said base to any of a plurality of desired positions, release of the force being effective to cause said engagement faces to re-engage to retain said second element relative to said first element in the desired positions* wherein the pivotal connection of one link element to one of said first and second elements is displaceable longitudinally from the pivotal connection of the one link element with the other of said elements, said first locking member being provided on said one link element and said second locking member being provided on the other of said elements, such longitudinal displacement being effective to move said locking members between their released and locked positions.

10. A support means as claimed in claim [1] *7* wherein said second element comprises a first portion interconnecting the other end of the link elements and a second portion pivotally supported from the first portion and supporting one of the locking members.

11. A support means [as claimed in claim 2] *for supporting a support platform from a fixed base whereby the support platform is movable between a first position at least partially below the fixed base and a second position in front of the fixed base, said support means comprising a first element adapted to be mounted to the support platform, a second element adapted to be affixed to said fixed base, a pair of linkage elements each pivotally fixed at one end to said first element at spaced intervals on said first element and each pivotally mounted at the other end to said second element at spaced locations spaced on said second element for movement of the support platform between the first and second positions and throughout such movement the attitude of said support platform remains substantially constant, said support means further comprising a locking means for locking said support platform in a range of positions including said second position, said locking means comprising a first locking member supported on one of said elements and having a first engagement face engagable with a second engagement face provided on a second locking member provided on another of said elements, said locking members being movable relative to each other upon the exertion of a force to one of these two elements for moving said locking members to a released position at which the engagable faces are disengaged for subsequent movement of said support platform relative to said base and gravitationally biased to any of a plurality of desired positions, at which the engagement faces are engaged to retain said second element relative to said first element in one of said range of positions* wherein the pivotal connection of one link element to one of said first and second elements is displaceable longitudinally from the pivotal connection of the one link element with the other of said elements, said first locking member being provided on said one link element and said second locking member being provided on the other of said elements, such longitudinal displacement being effective to move said locking members between their released and locked positions.

14. A support means as claimed at claim [2] *11* wherein one of said first element and second element comprises a first portion interconnecting the other end of the link elements and a second portion pivotally supported from the first portion and supporting one of the locking members.

17. A support means as claimed at claim [16] *3* wherein one of said link member is telescopic in length.

18. A support means as claimed at claim [16] *3* wherein the pivotal mounting of the one link element to the first element is provided by an elliptical or elongate aperture in one element and a pivot pin of the other element slidably received in the elliptical or elongate slot.

20. A support means as claimed at claim [19] *6* wherein said one link member is telescopic in length.

21. A support means as claimed at claim [19] *6* wherein the pivotal mounting of the one link element to the first element is provide by an elliptical or elongate aperture in one element and a pivot pin of the other element slidably received in the elliptical or elongate slot.

26. A support means as claimed at claim [5] *7* wherein the one engagement face has convex V-shaped profile and the other engagement face has a concave V-shaped profile.

34. A support means as claimed at claim [5] *7 wherein* [the first ] *locking* [member is provided on one link element and the second locking member is provided on one of the first or second elements, the pivotal connection of one link element to the one of said first and second elements is displaceable longitudinally from the pivotal connection of the one link element with the other of said first or second elements] *members are adapted to be frictionally interengagable when engaged with each other*.

40. A support means as claimed at claim [39] *4* wherein one link member is telescopic in length.

41. A support means as claimed at claim [39] *4* wherein the pivotal mounting of the one link element to the one of the first or second elements is provided by an elliptical or elongate aperture in one element and a pivot pin of the other element slidably received in the elliptical or elongate slot.

42. A support means as claimed at claim [39] *4* wherein the one engagement face has a convex V-shaped profile and the other engagement face has a concave V-shaped profile.

47. A support means [as claimed at claim 46] *for supporting a support platform from a fixed base wherein the support platform is movable between a first position at least partially below the fixed base and a second position in front of the fixed base, said support means comprising a first element adapted to be mounted to the support platform, a second element adapted to be affixed to said fixed base, a pair of linkage elements each pivotally fixed at one end to said first element at spaced intervals on said first element and each pivotally mounted at the other end to said second element at spaced locations spaced on said second element to enable movement of the support platform between the first and second positions whereby throughout such movement the attitude of said support platform remains substantially constant, said support means further comprising a locking means for locking said support platform in a range of positions including said second position, said locking means comprising a first locking member supported on one of said linkage elements and having a first engagement face engagable with a second engagement face provided on a second locking member provided on another of said elements, said locking members being relatively movable between a released position at which the engagable faces are disengaged to allow movement of said support platform relative to said base and gravitationally biased into a plurality of locking positions at which the engagement faces are engaged to retain said second element relative to said first element in one of said range of positions, at least one of said locking members being serrated and* wherein the pivotal connection of one link element to one of said first and second elements is displaceable longitudinally from the pivotal connection of the one link element with the other of said elements such longitudinal displacement being effective to move said locking members between their released and locked positions.

* * * * *